United States Patent [19]

Varga

[11] 4,044,817

[45] Aug. 30, 1977

[54] CONTINUOUS CASTING METHOD USING GRAPHITE MOLD IMPREGNATED WITH UNSATURATED DRYING OIL

[75] Inventor: William J. Varga, Woodbury, Conn.

[73] Assignee: Chase Brass & Copper Co., Incorporated, Waterbury, Conn.

[21] Appl. No.: 561,701

[22] Filed: Mar. 25, 1975

[51] Int. Cl.[2] ..... B22D 11/00

[52] U.S. Cl. ..... 164/138; 164/73

[58] Field of Search ..... 164/14, 73, 268, 273 R, 164/138; 106/38.24, 38.7; 249/134

[56] References Cited

U.S. PATENT DOCUMENTS

| | | | |
|---|---|---|---|
| 2,218,781 | 10/1940 | Baggett | 164/14 |
| 2,274,618 | 2/1942 | Remy | 106/38.7 X |
| 2,747,244 | 5/1956 | Goss | 164/268 |
| 3,023,112 | 2/1962 | Tobler | 106/38.7 |
| 3,076,241 | 2/1963 | Simonson et al. | 164/73 |
| 3,794,102 | 2/1974 | Binder | 164/273 RX |

FOREIGN PATENT DOCUMENTS

| | | | |
|---|---|---|---|
| 46-21903 | 6/1971 | Japan | 164/73 |
| 356,686 | 3/1930 | United Kingdom | 106/38.24 |

*Primary Examiner*—Robert D. Baldwin

[57] ABSTRACT

An improved graphite mold for and process of continuously casting metal wherein the interstitial space in the mold is impregnated with an unsaturated oil, or mixture of unsaturated oils, having a drying capability equivalent to at least soybean oil. Heat is applied to dry the oil, and subsequently metal is cast in the mold thereby carbonizing the oil or mixtures thereof in the interstitial space.

10 Claims, 2 Drawing Figures

CONTINUOUS CASTING METHOD USING GRAPHITE MOLD IMPREGNATED WITH UNSATURATED DRYING OIL

This invention pertains to an improved graphite mold or die which possesses outstanding properties. More particularly, this invention pertains to an improved method for casting continuously metals; still further, this invention pertains to a method for improving graphite dies or molds operated under high temperatures for casting nonferrous metals such as copper and its alloys.

BACKGROUND OF THE INVENTION

When casting metals and especially when casting metals in a continuous operation, the material from which the mold or die is made is of very great importance. Because the duration of casting and thus the success and economy of the casting process are related to the mold or die life, a long lasting mold or die is a very important element in the continuous casting process.

The duration of casting relates also to the start-up problems when a new die must be substituted, the variability of the cast as a result of die performance, and the ability to cast different types of alloys. When continuously casting metals of melt temperatures, such as copper and copper alloys of various types, it has been found that graphite molds or dies are conventionally preferred as the desirable material. However, graphite molds or dies have a working life which greatly depends on the durability of their surfaces in the area directly exposed to a molten metal. Inasmuch as the molds are prepared from carbonaceous aggregates under conditions well known in the art such as shown in U.S. Pat. No. 3,794,102, these aggregates have interstitial spaces. These spaces are often the sites for mold or die failure, i.e., the mold or die surfaces start to deteriorate and the quality of the mold suffers. As a result, the premature failure of continuously cast strand is experienced. As each breakage and interruption is a time consuming operation and the start-up problems often generate additional consequences, the desideratum in the art has been to extend the die on mold life as long as possible.

Thus, in U.S. Pat. No. 3,794,102, the various prior art attempts have been disclosed, such as, lubrication of the mold and the failures associated with lubricants, for example, solids, e.g., carbon black, oils, and liquids including viscous substrates such as tallow.

With respect to the improvement in the art, the above-mentioned patent proposed the impregnation of the graphite mold material with a glass or a flux. The glass and flux operates as a lubricant and softens or melts below the solidification temperature of the metal sought to be cast.

SUMMARY OF THE INVENTION

It has now been discovered that contrary to the prior art practices, a specific impregnant when used with a graphite die prolongs the life of the die, e.g., to twice that achieveable without the use of the impregnant. More specifically, the extended life, although different for each alloy, has improved the die and mold life in a highly unexpected and nonobvious matter. Thus, in a continuous casting process, the die life has been extended to surpass that observable with other dies.

Consequently, it is surmised that superior heat transfer between mold or die and the cooling means for the mold or die reduces the mold surface deterioration. Moreover, oxidation during preheat is minimized and the lubrication in some unexplainable manner of the die cast metal interface is achieved during casting operation.

These factors are characterized by the increased duration of casting, and ability to maintain high speed casting as well as improved surface quality of the cast material. Not only the above factors, but improved reproducability during start-up operations characterizes the present invention. Additionally, an increased range of alloys can now be cast successfully or cast at conditions where heretofore the casting in a graphite mold or die was marginally successful or not practicable.

As a consequence, the continuous casting process is improved by the utilization of the improved graphite molds.

THE DRAWINGS

With reference to the present drawings, these illustrate in:

FIG. 1, a continuous casting device for incorporating the improved die of the present invention;

FIG. 2 illustrates an apparatus for obtaining the improved mold or die.

DETAILED DESCRIPTION OF THE INVENTION AND EMBODIMENTS THEREOF

Figure 1:
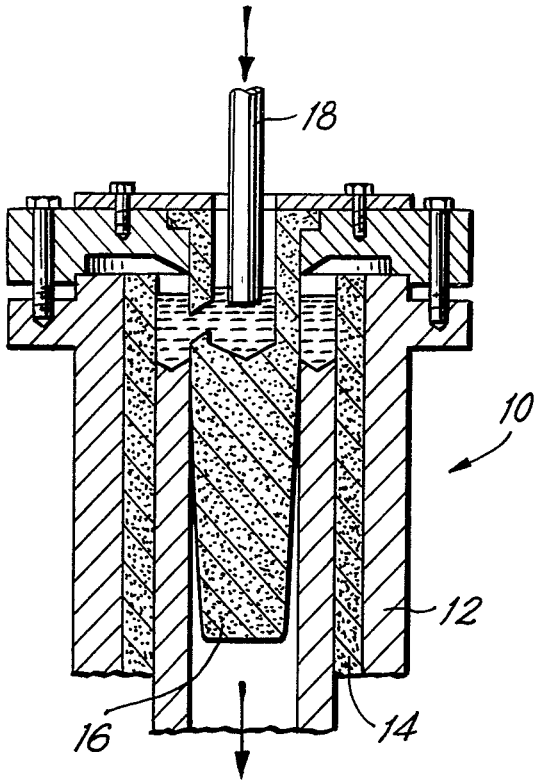

As mentioned above, the impregnant which has been found to be eminently useful is an unsaturate, which is generally characterized as an oil, but may be a glyceride of a given acid. These unsaturates are characterized as oils and are obtained often, by extraction, from the seeds of various plants or fish. The criterion for selecting the oil is that it must be capable of drying, i.e., the oil is characterized as drying or semi-drying oil. Illustrative sources of unsaturated oils are linseed oil, perilla oil, safflower oil, soybean oil, sunflower oil, tung oil, oiticica oil, cashew nut oil, etc., and dehydrated castor oil, that is, dehydrated ricinoleic acid.

In addition to the above, the naturally occuring oils which have a nondrying fraction and a drying fraction can also be utilized provided the drying fraction is separated or augmented to a point where it resembles at least the properties of soybean oil.

Consequently, the drying and semidrying oil may be used as well as the drying fractions of the nondrying vegetable oils. With reference to the definition of these oils as well as the source thereof, appropriate chemical texts, such as "Chemistry of Organic Compounds" Noller, first edition, W. B. Sounders and Co., 1951, Chapter 11, Page 177 et seq., are a useful guide for these oils including the chemical makeup, hence, the disclosure is incorporated by reference herein. In addition, in Payne, "Organic Coating Technology," Vol. 1, John Wiley & Sons, Inc., New York, 1954, Pages 42 – 129, appropriate drying, semidrying or other oils, the reesterified oils and species thereof, isomerized oils and adduct oils which are useful are described. However, the natural drying oils are preferred and safflower oil is the most desirable.

With respect to the procedure for impregnating the graphite die or mold, these are immersed in an oil and a hydrostatic pressure is applied to drive the oil into the graphite mold or die interstices. It has been found more convenient to evacuate first any air in the die, such as by vacuum and then to impregnate with oil under vacuum.

Thus, a more complete penetration of the oil into the interstices of the mold or die is accomplished.

The graphite die or mold manufacturing process is disclosed in the prior art such as in U.S. Pat. Nos. 3,794,102, 3,459,255, and others.

After the impregnation, the graphite mold is dried. Drying can be accelerated by using an elevated temperature such as up to 100° C and higher, but the main function of the drying is to obtain a nonsticky surface so that the mold can be easily handled.

Although the exact mechanism or reason why the unsaturates work and why the better drying oils such as safflower oil or tung oil work better than other oils has not been established, it is postulated that the interstitial space is being filled and carbonized during the molding operation so that not only a smoother die or mold surface is being provided, but also improved heat transfer properties apparently contribute to the heretofore unobserved improvements.

With reference to the improvements which have been obtained, the dies are considered as not performing when a 16 strand die casting loses 4 strands, the comparison with the treated and nontreated die molds is with reference to the identical and identified alloys. The base for comparison is the best run obtained with the impregnated die which is expressed as 100 percent both with respect to duration and amount cast for each alloy.

| ALLOY 2266 - JEWELRY BRONZE REGULAR MOLD BUT LINSEED IMPREGNATED | Duration as % of Maximum | Weight Cast as % of Maximum |
|---|---|---|
| Run Number | run | run |
| A | 70 % | 69.5 % |
| B | 60 % | 59.5 % |
| C | 80 % | 79 % |
| D (Maximum run) | 100 % | 100 % |
| ALLOY 2266 - JEWELRY BRONZE REGULAR MOLD (Nonimpregnated) | | |
| a | 50 % | 42.8 % |
| b | 50 % | 39.6 % |
| c | 50 % | 42.3 % |
| d | 50 % | 39.0 % |
| ALLOY 2606 - 70/30 BRASS LINSEED IMPREGNATED MOLDS | | |
| A-1 (Maximum run) | 100 % | 100 % |
| ALLOY 2606 - 70/30 BRASS REGULAR MOLD (Untreaded) | | |
| a-1 | 71 % | 62.2 % |

For a series of runs, three different molds were impregnated with linseed, tung oil, and safflower oil; the dies were operative after 7 days when the runs were terminated due to the metal requirement being fulfilled. There were no strand failures during the runs and the dies perform uniformly. Of the metals cast, copper and its alloys are the preferred species. Besides the above alloys of copper, other alloys cast via the novel mold or die are: copper with 1% silicon, copper with 1% cadmium; 85/15 brass; 87/13 brass; 93% copper, 7% tin; copper-phosphorous alloys; copper with 0.5% tellurium and other alloys of copper.

With reference to FIG. 1, the casting installation 10 includes a mold 12 having an impregnant of linseed oil or safflower oil for the graphite lining 14 with a mandrel 16 similarly being made of oil impregnated mold. A molten material is fed to the mold through inlet conduit 14. The above illustrated mold is merely exemplary and many other and multiple molds, dies, or orifices may be made employing the disclosed invention. A grade of graphite die known in the art as CGW graphite has been found suitable. Another suitable graphite die known in the art as POCO graphite is more dense and equally suitable.

Figure 2:
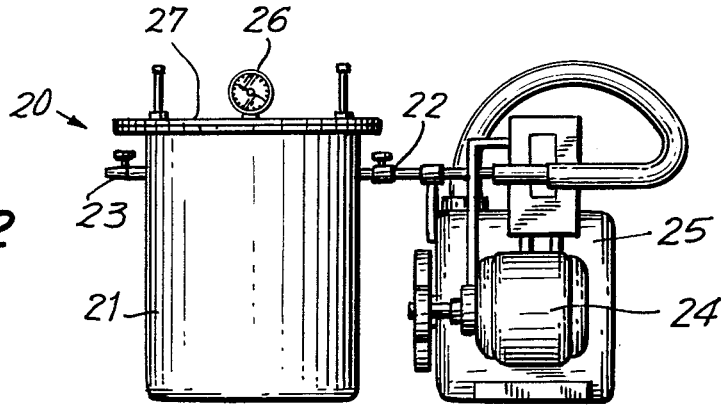

With reference to FIG. 2, it illustrates a suitable mold impregnation device comprising of a vessel 21 capable of resisting implosion from a vacuum applied therein and having both an outlet port 22 and an inlet port 23 for introducing into the evacuated vessel the above described oil. A motor 24 drives the vacuum pump 25. A suitable gauge 26 is mounted on the lid 27 of vessel 21. The vacuum is generally applied sufficiently to evacuate air in the die. A vacuum of 20 inches mercury applied for 24 hours has been found sufficient; lower vacuum will produce faster impregnation, while higher vacuum prolongs the time it takes to evacuate the air in the interstecies of the die. In general, the amount of impregnant incorporated in the mold is from 5% to 95% of the interstitial volume as measured by the evacuated air. On weight basis the amount of oil incorporated is from 0.5 to 10% but more usually from 1 to 5%. After the first impregnation and drying, the mold may be subjected again to impregnation and drying. It has been found that an 8 lb. die of CGW graphite will increase in weight after impregnation for 24 hours at 20 in. Hg from 2.3 to 3 %. A higher degree of impregnation will be achieved with less dense mold while less impregnation will be achieved with more dense mold or die.

The patents mentioned above for the necessary disclosure are incorporated by reference therein.

Besides the above description, the appended claims which further define the invention are directed to the invention and all reasonable equivalents thereof are encompassed within the claims.

I claim:

1. In a method of continuously casting of a metal using a graphite mold or die having interstitial space, the improvement comprising, impregnating the interstitial space in said graphite mold or die with an unsaturated oil or a mixture of unsaturated oils, wherein the unsaturated oil or mixtures thereof have a drying capability equivalent to at least soybean oil, applying heat to dry the same, and casting said metal thereby carbonizing said oil or mixtures thereof in said interstitial space.

2. The method as defined in claim 1 wherein the unsaturated oil is linseed oil.

3. The method as defined in claim 1 wherein the unsaturated oil is safflower oil.

4. The method as defined in claim 1 wherein the unsaturated oil is tung oil.

5. The method as defined in claim 1 wherein the unsaturated oil is a dehydrated castor oil.

6. In a process of continuously casting a nonferrous metal when using a graphite mold or die, the improvement comprising: impregnating the graphite mold or die with an unsaturated oil having a drying capability equivalent to at least soybean oil in the amount from 0.5 to 10% by weight, drying the oil, and exposing the mold or die to a hot metal when casting the metal whereby said oil is carbonized.

7. In the process as defined in claim 6, wherein the metal being cast is copper or copper alloy.

8. In the process as defined in claim 6, wherein the metal being cast is bronze.

9. In the process as defined in claim 6, wherein the metal cast is 70/30 brass.

10. The process as defined in claim 6, wherein the unsaturated oil is dried at a temperature up to 100° C.

* * * * *